United States Patent [19]

Krambeck et al.

[11] Patent Number: 4,645,589

[45] Date of Patent: Feb. 24, 1987

[54] PROCESS FOR REMOVING METALS FROM CRUDE

[75] Inventors: Frederick J. Krambeck, Cherry Hill; Chiu T. Lam, Sewell, both of N.J.; Paul H. Schipper, Wilmington, Del.

[73] Assignee: Mobil Oil Corporation, New York, N.Y.

[21] Appl. No.: 789,218

[22] Filed: Oct. 18, 1985

[51] Int. Cl.[4] ..... C10G 45/00; C10G 17/00

[52] U.S. Cl. ..... 208/251 R; 208/252

[58] Field of Search ..... 208/251 R, 252

[56] References Cited

U.S. PATENT DOCUMENTS

| | | | |
|---|---|---|---|
| 1,962,181 | 6/1934 | Egloff | 208/298 |
| 2,847,362 | 8/1958 | Kemp | 208/309 |
| 3,067,126 | 12/1962 | Leas | 208/251 H |
| 4,025,458 | 5/1977 | McKay | 208/113 |
| 4,031,002 | 6/1977 | McKay | 208/113 |
| 4,036,740 | 7/1977 | Roadal et al. | 208/120 |
| 4,111,845 | 9/1973 | McKay | 208/113 |
| 4,141,858 | 2/1979 | McKay | 208/120 |
| 4,148,717 | 4/1979 | Young | 208/251 H |
| 4,166,806 | 2/1979 | McKay et al. | 208/48 A |
| 4,167,471 | 9/1979 | Bertus et al. | 208/48 R |
| 4,192,736 | 3/1980 | Kluksdahl | 208/251 H |
| 4,207,204 | 6/1980 | McKay et al. | 208/48 AA |
| 4,208,302 | 6/1980 | McKay | 208/120 |
| 4,321,128 | 3/1982 | Yoo | 208/22 |
| 4,394,324 | 7/1983 | Mark et al. | 208/113 |
| 4,396,496 | 8/1983 | Scharf et al. | 208/120 |
| 4,399,024 | 8/1983 | Fukui et al. | 208/22 |
| 4,419,225 | 12/1983 | Kukes et al. | 208/251 R |
| 4,421,638 | 12/1983 | Nowack et al. | 208/251 R |
| 4,432,890 | 2/1984 | Beck et al. | 208/120 |
| 4,446,006 | 5/1984 | Albertson | 208/253 |
| 4,454,025 | 6/1984 | Hettinger, Jr. | 208/120 |
| 4,464,251 | 8/1984 | Kukes et al. | 208/221 |
| 4,465,589 | 8/1984 | Kukes et al. | 208/208 R |
| 4,518,484 | 5/1985 | Mann et al. | 208/87 |
| 4,522,702 | 6/1985 | Kukes et al. | 208/252 |
| 4,529,503 | 7/1985 | Kukes et al. | 208/251 R |

*Primary Examiner*—Andrew H. Metz
*Assistant Examiner*—Helane Myers
*Attorney, Agent, or Firm*—Alexander J. McKillop; Michael G. Gilman; Malcolm D. Keen

[57] ABSTRACT

A process for removing metal from a metal-containing hydrocarbon oil such as a heavy crude is disclosed which comprises:

(a) contacting a hydrocarbon oil phase containing at least one metal selected from the group consisting of vanadium and nickel with an aqueous phase of dissolved phosphorous compound capable of forming a compound or a complex with said metal, said aqueous phase containing a substantial quantity of water relative to the amount of liquid hydrocarbon contacted therewith, said contacting resulting in the removal of a substantial quantity of the metal from the hydrocarbon oil phase to the aqueous phase; and, (b) separating the metal-containing aqueous phase from the demetalated hydrocarbon oil phase prior to subjecting the latter to downstream catalytic processing.

16 Claims, 1 Drawing Figure

METAL REMOVAL FROM CRUDE OIL THROUGH COUNTER CURRENT EXTRACTION
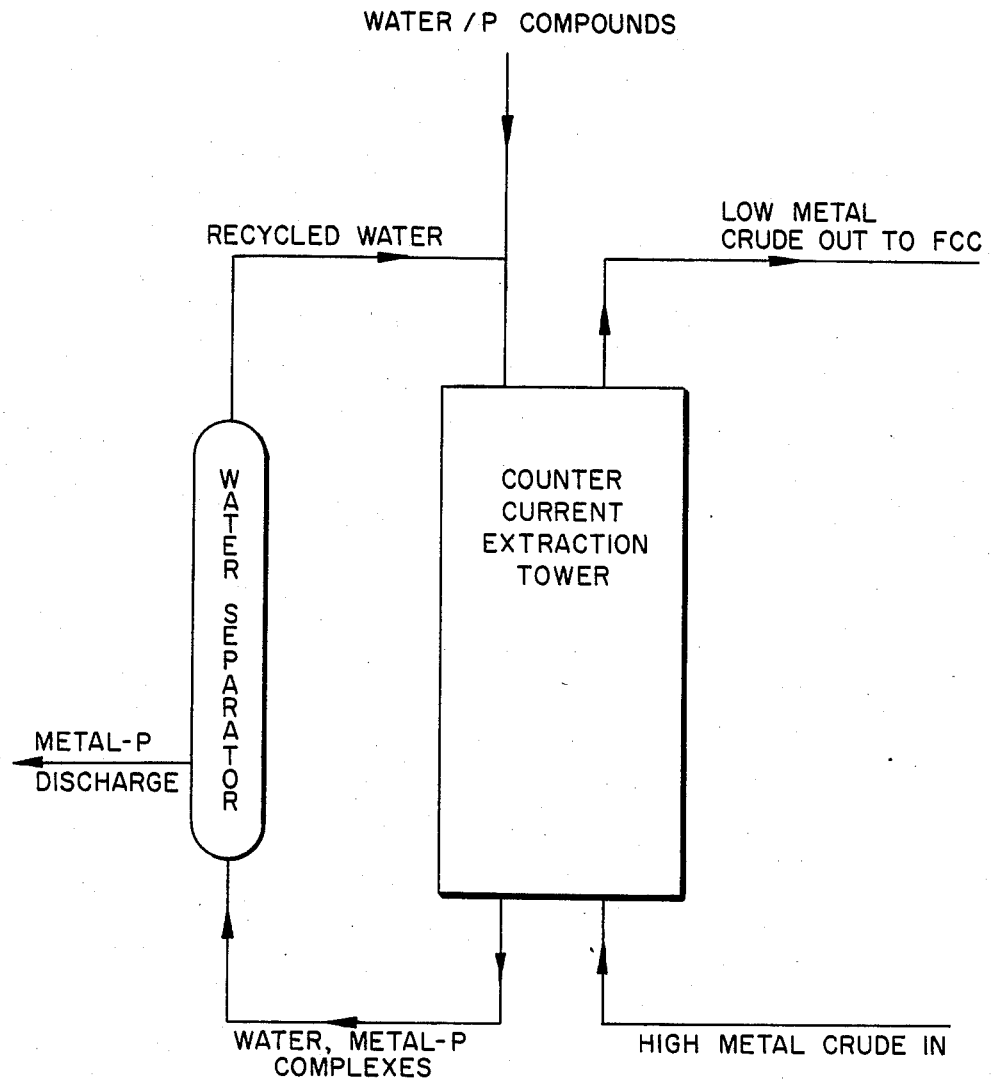

PROCESS FOR REMOVING METALS FROM CRUDE

BACKGROUND OF THE INVENTION

This invention relates to a process for removing metal contaminants such as nickel and vanadium from a hydrocarbon feed stock, e.g., heavy crude, resid, and the like, thereby upgrading the feedstock for a variety of further refinery operations such as fluidized catalytic cracking, hydrodesulfurization, etc.

It is well known that heavy crude oils, as well as products from extraction and/or liquefaction of coal and lignite, products from tar sands, products from shale oil and similar products may contain metals such as vanadium and nickel. The presence of the metals make further processing of heavier fractions difficult since the metals generally act as poisons for catalysts employed in processes such as catalytic cracking, hydrogenation or hydrodesulfurization. Consequently, a number of strategies have been developed to deal with the problem posed by the presence of metal contaminants in hydrocarbon oil feed stocks.

One approach calls for passivating the catalyst with an additive which reduces the tendency of the deposited nickel to catalyze the formation of coke and hydrogen and, where the catalyst is of the porous aluminosilicate zeolite variety, to immobilize vanadium and prevent or inhibit it from migrating to the zeolite framework where it causes activity loss. Illustrative of this approach are the passivation procedures disclosed in U.S. Pat. Nos. 4,025,458; 4,031,002; 4,111,845; 4,141,858; 4,166,806; 4,167,471; 4,207,204; 4,208,302; 4,394,324; and 4,396,496.

Another approach to the problem of metal contamination in a heavy crude feed stock is to add a substance to the feed stock which will form an oil insoluble precipitate with the metal contaminants. In many processes of this type, the metal-containing oil remains in the heavy crude feed stock even while the latter is undergoing further processing, e.g., catalytic cracking. Examples of such a procedure are described in U.S. Pat. Nos. 4,036,740; 4,148,717; 4,192,736; 4,321,128; 4,399,024; 4,419,225; 4,421,638; 4,432,890; 4,446,006; 4,454,025; 4,464,251; 4,465,589; 4,518,484; 4,522,702; and 4,529,503.

Heretofore, it has not been known to contact a metal-containing liquid hydrocarbon feed stock with a water-soluble phosphorous-containing compound dissolved in a substantial amount of water relative to the amount of oil to be treated and in this way, to remove contaminating metal(s) from the oil by their reaction or formation of a complex with the phosphorous-containing compound. Although it is known from U.S. Pat. No. 4,522,702 to contact a 40–80 weight percent aqueous solution of phosphorous acid demetalating agent with heavy crude oil, the amount of water employed is negligible compared to the amount of oil being treated.

SUMMARY OF THE INVENTION

In accordance with the present invention, a process is provided for reducing the metal content of a liquid hydrocarbon feed stock by extracting the feed stock with an aqueous solution of phosphorous compound containing large amounts of water relative to the amounts of feed to be treated. The extraction can be effected under fairly mild conditions and provides a demetallized crude which has been upgraded for downstream catalytic refinery operations.

Briefly stated, the demetallizing process of this invention comprises:

(a) contacting a hydrocarbon oil phase containing at least one metal selected from the group consisting of vanadium and nickel with an aqueous phase of dissolved phosphorous compound capable of forming a compound or a complex with said metal, said aqueous phase containing a substantial quantity of water relative to the amount of liquid hydrocarbon contacted therewith, said contacting resulting in the removal of a substantial quantity of the metal from the hydrocarbon oil phase to the aqueous phase; and, (b) separating the metal-containing aqueous phase from the demetalated hydrocarbon oil phase prior to subjecting the latter to downstream catalytic processing.

The expression "hydrocarbon oil" as used herein is primarily illustrated by crude oil but also includes such metal-contaminated feed stream as topped crude, resid, coal extract, coal pyrolyzate, shale oil, products from tar sands, and the like. The term "metal" applies to both free, or uncombined, vanadium and nickel as well as relatively nonvolatile compounds of these metals.

Employing the foregoing process, significant quantities of vanadium and/or nickel contaminant(s), e.g., from 20 to 80 weight percent of the amount of these metals originally present, can be removed from a hydrocarbon oil in a single extraction operation with even larger amounts of the metals being removed in a multistage extraction operation.

BRIEF DESCRIPTION OF THE DRAWING

The drawing is a flow diagram of a counter current aqueous extraction operation which can be used in carrying out the demetalation process of this invention.

DESCRIPTION OF THE PREFERRED EMBODIMENTS

The present invention is particularly directed to the demetalation of liquid hydrocarbon feed streams such as heavy crude oils and other materials which are generally regarded as being too heavy to be distilled. These feed streams will generally contain the highest concentrations of metals such as vanadium and nickel. Typically, the feed stocks employed will contain from about 10 to 1000 ppm of vanadium and from about 5 to about 500 ppm of nickel.

In carrying out the process of this invention, a quantity of hydrocarbon oil feed stock is contacted with a relatively substantial quantity of water in which there is dissolved one or more phosphorous compounds capable of forming a compound or complex with the vanadium and nickel components of the feed and extracting the metals into the water. Examples of suitable phosphorous compounds which are particularly effective are: $P_2O_5$, $H_3PO_4$, $(NH_4)_3PO_4$, $(NH_4)_2HPO_4$, $(NH_4)H_2PO_4$, $H_4P_2O_7$, $PSBr_3$, $H_3PO_2$, $H_3PO_3$, $(NH_4)H_2P_2O_7$, phosphorylamide ($PO(NH_2)_3$), amino-tris(methane phosponic acid) and 1-hydroxyethyl di-phosphonic acid The effective amount of one or more phosphorous compounds dissolved in water is preferably that which results in an atomic ratio of phosphorus atoms, from said one or more compounds, to total number of atoms of vanadium and/or nickel metal contaminants in the range of about 0.01:1 to about 3:1, and preferably in the range of about 0.03:1 to about 1:1. In general, the weight ratio of phosphorous compound to hydrocarbon feed stream will vary from about 1:500 to 1:5, preferably from about 1:200 to about 1:10 and most preferably from about 1:100 to about 1:25 with the nature of the phosphorous compound, its effectiveness in extracting metal from the hydrocarbon oil and cost being principal considerations in determining appropriate ratios.

Unlike some known demetalation processes which at most will employ only a demetallizing agent-dissolving amount of water, the process of this invention employs a fairly large quantity of water relative to the amount of hydrocarbon oil undergoing demetalation. So, for example, from about 0.5 to about 20 parts by weight of water per part by weight of oil, preferably from about 0.1 to about 10 parts by weight of water per part by weight of oil, and most preferably from about 0.2 to about 1 parts by weight of water per part by weight of oil, can be used herein with good results. The phosphorous compound in the desired amount can be dissolved in the water prior to contact of the latter with the oil or it can be added directly to the oil with or without a solution-forming amount of water, the balance of the water required being subsequently contacted with the phosphorous compound-containing oil. It is also within the scope of the process to contact the foregoing quantities of water with the metal-containing oil, the phosphorous compound thereafter being contacted with the oil/water mixture in a separate stream. The present process also contemplates the possibility of contacting the mixture with an oxygen-containing gas such as air.

The hydrocarbon stream can be contacted with the aqueous phosphorous compound in any suitable manner, e.g., by batchwise or continuous counter current extraction, and in a single stage or in a multi-stage extraction unit. Of course, it will be recognized that where the densities of the aqueous phosphorous compound and hydrocarbon oil to be treated are very close and the interfacial tension is below recognized minimums, continuous counter current extraction may not be suitable and some other contacting procedure must be utilized. Time of contact between the oil and the aqueous phosphorous compound can vary widely it only being necessary that the duration of contact be at least sufficient to provide for a significant reduction in the vanadium and nickel content of the oil feed. Contact times of just a few minutes, e.g., 5 to 10 minutes or so, up to 60 minutes and even longer are suitable in most cases.

The metal(s) extraction procedure herein can be carried out at any suitable temperature. The temperature will generally range from a minimal demetallizing temperature to any economically practical temperature. Preferably, the temperature will be in the range of about 50° C. to about 300° C. and most preferably from about 80° C. to about 200° C. Higher temperatures than the aforestated may improve the removal of metals but temperatures should not be utilized which will have adverse effects on the hydrocarbon containing feed stream. Lower temperatures than those mentioned can generally be used for lighter feeds. Of course, it will be realized that with temperatures in excess of 100° C., pressurized vessels are required to maintain a liquid system.

A method of contact which can be used herein is illustrated in the drawing and consists in counter current contact of the liquid hydrocarbon stream with the phosphorous compound dissolved in the full amount of water utilized in the process. Known and conventional equipment is contemplated throughout. Thus, a high metals content crude oil feed is introduced into the bottom of a counter current extraction tower where it is contacted with a phosphorous compound-containing aqueous stream introduced to the top of the tower. During counter current passage of the two streams through the extraction tower, phosphorous compound reacts or forms a complex with a substantial amount of the vanadium and nickel present in the oil resulting in the extraction of these metals from the oil phase into the aqueous phase. The phosphorous-metal compound(s)-/complex(es) so formed are withdrawn from the bottom of the extraction tower and the demetallized crude is withdrawn from the top of the tower where it is conveyed to a downstream catalytic process, e.g., fluidized catalytic cracking (FCC). If desired, metal(s) contained in the aqueous stream withdrawn from the extraction tower can be separated therefrom with the water component of the stream being recycled to process. Considerations of cost permitting, the metals can be separated from the phosphorous compound/complex with which they are associated with the phosphorous compound being optionally recycled to process.

The following examples are further illustrative of the demetalation method of the invention. In all cases, the liquid hydrocarbon feed was an atmospheric resid originally containing 23 ppm vanadium and 6 ppm nickel.

EXAMPLE 1

Two parts by weight of a 17 weight percent solution of phosphoric acid ($H_3PO_4$) were mixed with 5 parts by weight of the atmospheric resid. The mixture was heated to 95° C. and stirred for 30 minutes after which the aqueous layer was separated from the oil layer. Analysis of the oil layer indicated that about 35 weight percent of the vanadium and 37 weight percent of the nickel had been removed therefrom. A second cycle of extraction of the separated oil layer with the same weight ratio of phosphoric acid solution under substantially the same conditions removed a further 13 weight percent of vanadium from the original oil.

EXAMPLE 2

1000 Ppm by weight of 1-hydroxyethyl di-phosphonic acid (HEDP) in 17 weight percent aqueous phosphoric acid was prepared. Two parts by weight of the aqueous solution were mixed with 5 parts by weight of atmospheric resid. The mixture was heated to 95° C. and stirred for 30 minutes. After separating the aqueous layer, analysis of the oil layer indicated that 39 weight percent vanadium and 41 weight percent nickel had been removed from the original oil.

EXAMPLES 3–7

In separate extraction procedures, three different phosphorous compounds were employed: HEDP; amino-tris (methanephosphonic acid) (ATP); and, $H_3PO_4$. As in the previous examples, two weight parts of an aqueous solution of the phosphorous compounds were contacted with five weight parts of atmospheric resid for 30 minutes at 90° C. accompanied by stirring. The results of these extraction procedures are set forth in the accompanying table.

TABLE

Demetalation of Atmospheric Resid With Various Phosphorous Compounds

| Example | Phosphorus Compound | Phosphorous Compound/Resid (wt. percent) | Oil Layer After Extraction Vanadium, ppm | Oil Layer After Extraction Nickel, ppm |
|---|---|---|---|---|
| 3 | HEDP | 8.6 | 12 | 3.3 |
| 4 | HEDP | 4.3 | 18 | 4.0 |
| 5 | ATP | 7.1 | 11.2 | 2.5 |
| 6 | ATP | 3.6 | 16 | 4.8 |
| 7 | $H_3PO_4$ | 5.1 | 15 | 3.8 |

What is claimed is:

1. A process for removing metal from a metal-containing hydrocarbon oil which comprises:

(a) contacting a hydrocarbon oil phase containing at least one metal selected from the group consisting of vanadium and nickel with an aqueous phase of dissolved phosphorous compound capable of forming a compound or a complex with said metal, said aqueous phase containing from about 0.1 to about 20 parts by weight of water per part by weight of hydrocarbon oil contacted therewith, said contacting resulting in the removal of a substantial quantity of the metal from the hydrocarbon oil phase to the aqueous phase; and, (b) separating the metal-containing aqueous phase from the demetalated hydrocarbon oil phase prior to subjecting the latter to downstream catalytic processing.

2. The process of claim 1 wherein the hydrocarbon oil is a heavy crude oil containing from about 10 to about 1000 ppm vanadium and from about 5 to about 500 ppm nickel.

3. The process of claim 1 wherein the phosphorous compound is selected from the group consisting of $P_2O_5$, $H_3PO_4$, $(NH_4)_3PO_4$, $(NH_4)_2HPO_4$, $(NH_4)H_2PO_4$, $H_4P_2O_7$, $PSBr_3$, $H_3PO_2$, $H_3PO_3$, $(NH_4)H_2P_2O_7$, phosphorylamide ($PO(NH_2)_3$), amino-tris(methanephosponic acid) and 1-hydroxyethyl di-phosphonic acid.

4. The process of claim 1 wherein the atomic ratio of atoms of phosphorus said phosphorous compound to atoms of vanadium and/or nickel present in the hydrocarbon oil is from about 0.01:1 to about 3:1.

5. The process of claim 1 wherein the atomic ratio of atoms of phosphorus in said phosphorous compound to atoms of vanadium and/or nickel present in the hydrocarbon oil is from about 0.03 to about 1:1.

6. The process of claim 1 wherein the weight ratio of phosphorous compound to hydrocarbon oil is from about 1:500 to about 1:5.

7. The process of claim 1 wherein the weight ratio of phosphorous compound to hydrocarbon oil is from about 1:200 to about 1:10.

8. The process of claim 1 wherein the weight ratio of phosphorous compound to hydrocarbon oil is from about 1:100 to about 1:25.

9. The process of claim 1 wherein from about 0.1 to about 10 parts by weight of water per part by weight of hydrocarbon oil are employed.

10. The process of claim 1 wherein from about 0.2 to about 1 part by weight of water per part by weight of hydrocarbon oil are employed.

11. The process of claim 1 carried out at a temperature of from about 50° to about 300° C.

12. The process of claim 1 carried out at a temperature of from about 80° to about 200° C.

13. The process of claim 1 wherein the hydrocarbon oil is contacted with the aqueous phosphorous compound for from 5 minutes to about 60 minutes.

14. The process of claim 1 wherein the demetalated hydrocarbon is recycled to step (a).

15. The process of claim 1 employing batchwise counter current extraction.

16. The process of claim 1 employing continuous counter current extraction.

* * * * *